US008657211B2

(12) United States Patent
Ueda et al.

(10) Patent No.: US 8,657,211 B2
(45) Date of Patent: Feb. 25, 2014

(54) WATER SPOUTING DEVICE

(75) Inventors: Suguru Ueda, Kyoto (JP); Masaki Usui, Kyoto (JP)

(73) Assignee: KDF Co., Ltd., Kyoto (JP)

( * ) Notice: Subject to any disclaimer, the term of this patent is extended or adjusted under 35 U.S.C. 154(b) by 427 days.

(21) Appl. No.: 13/062,865

(22) PCT Filed: Sep. 10, 2009

(86) PCT No.: PCT/JP2009/004493

§ 371 (c)(1),
(2), (4) Date: Mar. 8, 2011

(87) PCT Pub. No.: WO2010/029748

PCT Pub. Date: Mar. 18, 2010

(65) Prior Publication Data

US 2011/0163122 A1 Jul. 7, 2011

(30) Foreign Application Priority Data

Sep. 12, 2008 (JP) ..... 2008-234884

(51) Int. Cl.
*B05B 7/32* (2006.01)
*F23D 11/24* (2006.01)
*F23D 14/28* (2006.01)

(52) U.S. Cl.
USPC ..... 239/349; 239/369; 239/565; 239/124; 239/170

(58) Field of Classification Search
USPC ..... 239/337, 346–349, 353, 369, 373, 565, 239/124, 170
See application file for complete search history.

(56) References Cited

U.S. PATENT DOCUMENTS 3,977,474 A * 8/1976 Boegli ..... 169/9
4,318,443 A * 3/1982 Cummins ..... 169/15

(Continued)

FOREIGN PATENT DOCUMENTS

JP U-02-095565 7/1990
JP A-04-145974 5/1992

(Continued)

OTHER PUBLICATIONS

Supplemental European Search Report issued in Application No. 09812897.8; Dated Aug. 3, 2011.

(Continued)

*Primary Examiner* — Justin Jonaitis
(74) *Attorney, Agent, or Firm* — Oliff PLC

(57) ABSTRACT

In a second tank unit, a controller controls the on/off switching of a water supply solenoid valve so that water is stored in a sub tank within the level of Lu to Ll. At the same time, the controller controls the on/off switching of a pressurizing solenoid valve and a decompressing solenoid valve so that the air pressure in the upper space in the sub tank is maintained at a target value. As a result, regardless of the water level in the sub tank, the back pressure in the tank is maintained at the target value higher than atmospheric pressure. In this state, when a central controller turns on a water spouting solenoid valve, pressured water rapidly spouts from a nozzle. Moreover, a change in the target values of the back pressure promptly changes the height of the spouting water. Accordingly, water spouting can be promptly started/stopped, and the height or size of the spouting water can be readily and smoothly changed.

2 Claims, 2 Drawing Sheets

(56) References Cited

U.S. PATENT DOCUMENTS

| | | | | |
|---|---|---|---|---|
| 5,133,500 | A * | 7/1992 | Simpson | 239/150 |
| 5,934,558 | A | 8/1999 | Samayoa et al. | |
| 6,009,954 | A * | 1/2000 | Phillips | 169/16 |
| 6,155,351 | A * | 12/2000 | Breedlove et al. | 169/14 |
| 6,802,762 | B2 * | 10/2004 | Tanaka et al. | 451/60 |

FOREIGN PATENT DOCUMENTS

| | | |
|---|---|---|
| JP | A-05-184995 | 7/1993 |
| JP | U-06-031863 | 4/1994 |
| JP | A-11-201050 | 7/1999 |
| JP | A-2001-205156 | 7/2001 |
| JP | A-2004-148233 | 5/2004 |

OTHER PUBLICATIONS

International Search Report issued in Application No. PCT/JP2009/004493; Dated Oct. 20, 2009 (With Translation).

Chinese Office Action issued in Application No. 200980131734.0; Dated Jan. 22, 2013 (With Translation).

* cited by examiner

WATER SPOUTING DEVICE

TECHNICAL FIELD

The present invention relates to a water spouting device for the purpose of decoration or viewing, specifically a water spouting device that spouts water using compressed air.

BACKGROUND ART

Well-known fountain devices installed in places like parks are roughly divided into two kinds based on the technique used to spout water from a nozzle, namely those which supplies water by a pressure generated by driving a feeding pump and those which utilizes compressed air generated by a compressor or similar devices. In the former, the system structure is relatively simple, but the starting or stopping of the spouting water tends to be delayed due to a time gap between driving of the feeding pump and actual delivering of water at a predetermined pressure. In the latter, the system structure tends to be complex, but is advantageous in that the starting or stopping of the spouting water is quick.

The fountain device using the latter technique disclosed in Patent Document 1 has a water charge tank which is connected to a nozzle for spouting water and in which water is stored, an air charge tank which is connected to the water charge tank via an open/close valve and in which high pressure air is charged, and a compressor for supplying high pressure air to the air charge tank. In the fountain device, the high pressure air in the air charge tank is supplied into the water charge tank by opening the open/close valve so that the water stored in the water charge tank is discharged by the air pressure from the nozzle.

However, in the aforementioned conventional fountain device, a time delay occurs between the supply of the high pressure air to the water charge tank by opening the open/close valve and the spouting of water from the nozzle. For this reason, there is a limitation on speeding up the start of the spouting water. Further, since the height or size of the spouting water is controlled by the amount of water supplied to the water charge tank, it is difficult to promptly change the height or size of the spouting water. Moreover, when the heights of spouting water from a plurality of nozzles are changed all together, the heights tend to vary.

In the case of fountain devices with which people enjoy only the movement of spouting water, such as an angular change or rotary motion of the spouting water, such time delay as mentioned earlier does not pose notable problems. Meanwhile, as disclosed in Patent Document 2, fountain devices synchronized with music or lights have been recently developed to increase the entertainment aspect of fountains. In order to better synchronize spouting water and other elements such as music and lights, faster starting or stopping of the spouting water or faster changing of the height or size of the spouting water is very important, which still pose a major problem to be solved for conventional fountain devices.

PRIOR ART DOCUMENT

Patent Document

[Patent Document 1] JP-A 2001-205156
[Patent Document 2] JP-A 2004-148233

SUMMARY OF THE INVENTION

Problems to be Solved by the Invention

The present invention has been developed to solve the aforementioned problems, and the main objective thereof is to provide a water spouting device which can have improved ornamental and entertainment properties by speeding up the starting/stopping of the spouting water or by more quickly changing the height or size of the spouting water.

Means for Solving the Problems

The present invention created to solve the problems is a water spouting device including: a) a nozzle for spouting water; b) a closed first water storage container for storing water at a water level within a predetermined range; c) a compressed air supplier for feeding compressed air in an upper space in the first water storage container; d) an aqueduct for connecting the first water storage container and the nozzle; e) an open/close valve provided at a point in the aqueduct; and f) a controller for controlling the spouting of water from the nozzle and the stopping of the spouting water by opening or closing the open/close valve, while controlling the compressed air supplier on the feeding of compressed air in a manner as to maintain the air pressure in the upper space in the first water storage container at a predetermined level.

The compressed air supplier may include, for example, an air compressor and an electromagnetic open/close valve. The water storage container may be provided with a pressure sensor for detecting the air pressure in the upper space in the water storage container. The controller may be constructed so as to control the opening or closing of the electromagnetic open/close valve for feeding the compressed air supplied from the air compressor to the water storage container in such a manner that a pressure detected by the pressure sensor becomes a target value.

One preferable embodiment of the water spouting device according to the present invention further includes: g) a water supplier for supplying water to the first water storage container; and h) a water-supply controller for monitoring the water level in the first water storage container and controlling the water supplier to keep the water level within a predetermined range.

In the water spouting device of the present invention, the amount of the compressed air to be supplied into the water storage container is controlled in a manner that the air pressure in the upper space in the water storage container remains at a desired value that is higher than the atmospheric pressure, with at least a predetermined amount of water always stored in the water storage container. That is to say, back-pressure in the closed water storage container is controlled to be at a constant level. Upon opening the open/close valve which has been kept closed while the predetermined back-pressure is applied to the water stored in the water storage container, the water stored in the water storage container is swiftly pressed into the aqueduct to the nozzle due to the pressure difference between the air pressure outside a spouting hole of the nozzle (which is normally at atmospheric pressure) and the back-pressure inside the water storage container. As a result, the water spouts from the spouting hole of the nozzle, thereby forming a water column.

Although the volume of the upper space in the water storage container increases as the water level in the water storage container is decreased by the spouting water from the nozzle, the back-pressure is maintained almost constant (provided the desired value is not changed) by the compressed air that is promptly supplied by the compressed air supplier. When the water level in the water storage container is decreased to a certain level, water is supplied to the water storage container by the water supplier, whereby the water level in the water storage device is restored. For stopping the spouting water from the nozzle, the open/close valve is closed. As this operation blocks the pressing force applied to the water in the nozzle or in the aqueduct on the downstream side of the open/close valve, the spouting water from the nozzle promptly stops.

The momentum of the spouting water from the nozzle, i.e. the height of the spouting water, mainly depends on the pressure difference between the air pressure outside the spouting hole of the nozzle and the back-pressure in the water storage container. Thus, a change in the target value of the air pressure in the upper space in the water storage container causes a change in the flow rate (flow amount) of water to be pressure-supplied from the water storage container to the aqueduct, resulting in a change in the height or size of the water spouting from the spouting holes of the nozzle. Since the change in the air pressure in the upper space, i.e. back pressure, in the water storage container is immediately reflected upon the height or size of the spouting water, the height or size of the spouting water can be promptly changed by changing the predetermined pressure with the controller depending on the desired height or size of the spouting water.

As a first embodiment of the water spouting device of the present invention, the water supplier may be a pump.

As a second embodiment of the water spouting device of the present invention, the water supplier may include: g1) a second closed water storage container for storing water at a water level within a predetermined range; g2) a second compressed air supplier for feeding compressed air in an upper space in the second water storage container; g3) a second aqueduct for connecting the second water storage container and the first water storage container; and g4) a second open/close valve provided at a point in the second aqueduct, wherein the water-supply controller controls the supply of water to the first water storage container and the stopping of the water supply by opening or closing the second open/close valve, while controlling the second compressed air supplier on the feeding of compressed air in a manner as to maintain the air pressure in the upper space in the second water storage container at a second predetermined pressure that is higher than the aforementioned predetermined pressure.

In the second embodiment, the water supplier feeds water to the water storage container utilizing the pressure difference generated by controlling the back pressure in the second water storage container disposed on the upstream side of the first water storage container. Meanwhile, according to the first embodiment, water is forcibly supplied to the water storage container by driving the pump. Therefore, the first embodiment is more preferable in the case of a large-scale water spouting device which has long aqueducts or the like.

Effects of the Invention

The water spouting device according to the present invention is capable of very promptly starting or stopping spouting water or changing the height or size of spouting water. Further, the water spouting device can smoothly perform continuous changes of the height or size of spouting water. Therefore, in the case of, for example, synchronizing the shape of the spouting water with other elements such as music and lights, the water spouting device can achieve excellent synchronization and thus improve ornamental and entertainment properties as compared with conventional products.

MODES FOR CARRYING OUT THE INVENTION

The following description will discuss details of the water spouting device according to examples of the present invention with reference to the attached drawings.

Figure 1:
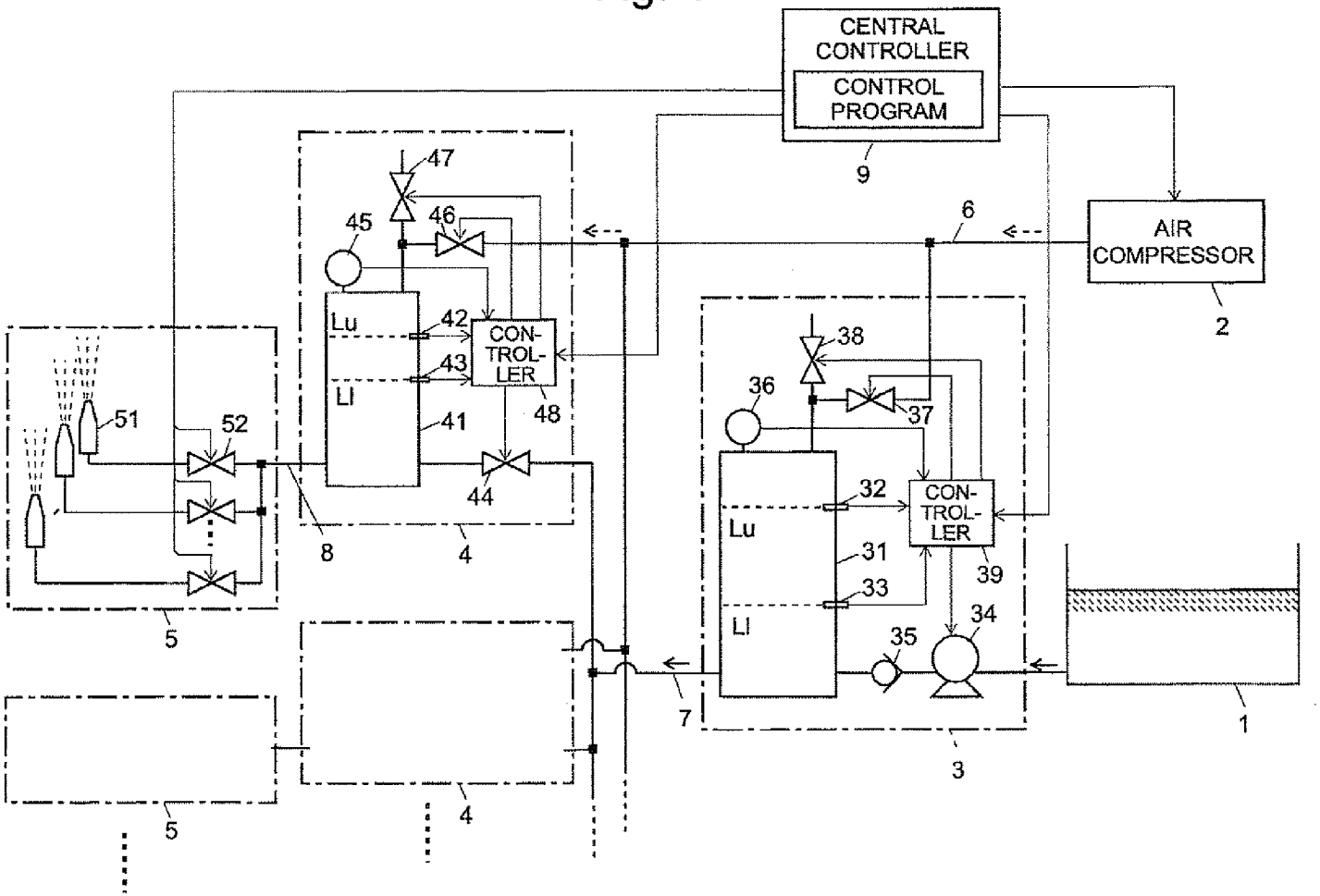
FIG. 1 is a schematic diagram showing a water spouting device according to one example of the present invention.

FIG. 1 is a schematic diagram showing the main components of a water spouting device according to the first example. The water spouting device includes a water storage tank 1, an air compressor 2, a first tank unit 3, a plurality of second tank units 2, a plurality of water spouting units 5, and a central controller 9.

The water storage tank 1 may be a fountain pond or a water receiving tank for collecting water spouted from the water spouting units 5. The central controller 9 has a control program and may consist of, for example, a personal computer.

The first tank unit 3 includes a closed main tank 31 having appropriate pressure resistance, an upper water level sensor 32 and a lower water level sensor 33 for detecting the level (Lu, Ll) of water stored in the main tank 31, a pump 34 for feeding water from the water storage tank 1 to the main tank 31, a check valve 35 for preventing the back-flow of water from the main tank 31 to the water storage tank 1, a pressure sensor 36 for detecting the air pressure in the upper space in the main tank 31, a pressurizing solenoid valve 37 for supplying compressed air into the main tank 31, a decompressing solenoid valve 38 for reducing the air pressure in the upper space in the main tank 31, and a controller 39 responsible for the general control of the first tank unit 3.

Each of the plurality of second tank units 4 includes a closed sub tank 41 having appropriate pressure resistance, an upper water level sensor 42 and a lower water level sensor 43 for detecting the water level (Lu, Ll) of water stored in the sub tank 41, a water supply solenoid valve 44 for supplying water in the sub tank 41, a pressure sensor 45 for detecting the gas pressure in the upper space in the sub tank 41, a pressurizing solenoid valve 46 for supplying compressed air into the sub tank 41, a decompressing solenoid valve 47 for reducing air pressure in the upper space in the sub tank 41, and a controller 48 for controlling the elements in the second tank unit 4.

The water spouting unit 5 is provided to each of the second tank units 4, and includes water spouting solenoid valves 52 respectively provided to terminal aqueducts 8, the terminal aqueduct 8 having one end connected to a water outlet in the lower portion of the sub tank 41 and the other end branched into multiple lines, and nozzles 51 each having a spouting hole for spouting water and being connected to an end of the terminal aqueduct 8. Meanwhile, the nozzle 51 is not necessarily connected one-to-one with the water spouting solenoid valve 52; alternatively, a plurality of the nozzles 51 disposed in parallel with one another may be connected to the same point on the downstream of a single water spouting solenoid valve 52. The shape of the nozzle 51 or the shape of the spouting hole are not particularly limited.

A compressed air supply tube 6 is connected to a compressed air outlet of the air compressor 2. The compressed air supply tube 6 is branched into two lines, one line connected to the pressurizing solenoid valve 37 of the first tank unit 3 and the other line connected to the pressurizing solenoid valves 46 of the respective second tank units 4. A main aqueduct 7 is connected to a water outlet in the lower portion of the first tank unit 3. The main aqueduct 7 is branched into multiple lines connected to the water supply solenoid valves 44 of the respective second tank units 4.

The central controller 9, which controls the operation of the whole water spouting device, controls the operation of the air compressor 2 and the on/off operation of the water spouting solenoid valves 52 of each of the water spouting unit 5. The central controller 9 also gives a target value for controlling the air pressure to the controller 39 in the first tank unit 3 and the controller 48 in each of the second tank units 4. As mentioned below, the target value for controlling the air pressure is a parameter to change the height or size of the spouting water from each of the nozzles 51.

In the water spouting device, each of the nozzles 51 can be freely rotated on two orthogonal axes by a motor. This configuration makes it possible to set the direction of the spouting water at an angle within a predetermined range; however, since the structure does not directly relate to the present invention, explanation thereon is omitted.

The following description will discuss the operation of the water spouting device according to the embodiment having the foregoing structure.

In the first tank unit 3, the controller 39 controls the operation of the pump 34 in response to detection signals from the upper water level sensor 32 and the lower water level sensor 33 to maintain the level of the stored water in the main tank 31 between Lu and Ll which are determined by the locations of the upper water level sensor 32 and the lower water level sensor 33. Specifically, when the water level falls below the Ll due to outflow of water from the main tank 31 so that the lower water level sensor 33 is turned off, the controller 39 operates the pump 34 to suction the stored water in the water storage tank 1 and feed the water into the main tank 31. As a result, the water level in the main tank 31 is restored. When the water level reaches the Lu so that the upper water level sensor 32 is turned on, the controller 39 stops the pump 34. As a result, no more water flows into the main tank 31, and thus the space for compressed air to be fed is secured in the main tank 31.

The operation of the pump 34 may be controlled by the simple on-off switching. Alternatively, an inverter control may be used to variably change the amount of the water supply. Moreover, the water supply to the main tank 31 may be controlled by the on-off switching of a solenoid valve installed on an aqueduct between the pump 34 and the main tank 31 instead of the on-off switching of the pump 34.

The air compressor 2 sends compressed air at a predetermined air pressure P1 to the compressed air outlet. In the first tank unit 3, the controller 39 controls the on-off switching of the pressurizing solenoid valve 37 and the decompressing solenoid valve 38 in such a manner that the air pressure in the upper space in the main tank 31 detected with the pressure sensor 36 becomes a target value P2 indicated by the central controller 9. The target value P2 is lower than the air pressure P1 which is the pressure of compressed air provided by the air compressor 2.

The controller 39 turns on the pressurizing solenoid valve 37 when the pressure detected by the pressure sensor 36 is below the target value P2. As a result, the pressure difference as mentioned earlier causes the inflow of compressed air through the compressed air supply tube 6 into the upper space in the main tank 31, which increases the air pressure in the upper space in the main tank 31. Then, the controller 39 turns off the pressurizing solenoid valve 37 when the detected pressure reaches the target value P2. Meanwhile, the controller 39 turns on the decompressing solenoid valve 38 when the pressure detected by the pressure sensor 36 exceeds the target value P2. As a result, the air in the upper space in the main tank 31 is released from the main tank 31 so that the air pressure decreases. The controller 39 turns off the decompressing solenoid valve 38 at the time when the detected pressure reaches the target value P2.

As described later, as the level of the stored water in the main tank 31 falls due to the spouting of water from the nozzles 51, the volume of the space above the water increases, reducing the air pressure. At this moment, the pressurizing solenoid valve 37 is turned on and thus the air pressure is immediately restored to the target value P2 as described earlier. Moreover, when the level of the stored water in the main tank 31 falls below the Ll and then the pump 34 starts supplying water to raise the water level, the volume of the space above the water decreases, increasing the air pressure. At that moment, the decompressing solenoid valve 38 is turned on and thus the air pressure is immediately restored to the target value P2 as described earlier. Accordingly, regardless of the vertical change in the level of the stored water in the main tank 31, an air pressure substantially corresponding to the target value P2 is constantly applied on the stored water in the main tank 31.

In each of the second tank units 4, the controller 48 controls the on-off switching of the pressurizing solenoid valve 46 and the decompressing solenoid valve 47 in such a manner that the air pressure in the upper space in the sub tank 41 detected with the pressure sensor 45 becomes a target value P3 indicated by the central controller 9. The target value P3 is always lower than the air pressure P2 in the first tank unit 3. Specifically, the controller 48 turns on the pressurizing solenoid valve 46 when the pressure detected by the pressure sensor 45 is below the target value P3. As a result, compressed air flows through the compressed air supply tube 6 into the upper space in the sub tank 41, which increases the air pressure. The controller 48 turns off the pressurizing solenoid valve 46 when the detected pressure reaches the target value P3. Meanwhile, the controller 48 turns on the decompressing solenoid valve 47 when the pressure detected by the pressure sensor 45 exceeds the target value P3. As a result, the air in the upper space in the sub tank 41 is released from the sub tank 41 so that the air pressure decreases. The decompressing solenoid valve 47 is turned off at the time when the detected pressure reaches the target value P3.

In each of the second tank units 4, the controller 48 controls the on-off operation of the water supply solenoid valve 44 in response to detection signals from the upper water level sensor 42 and the lower water level sensor 43 to maintain the level of the stored water in the sub tank 41 between Lu and Ll which are determined by the locations of the upper water level sensor 42 and the lower water level sensor 43. That is to say, when the water level falls below the Ll due to outflow of the stored water so that the water level sensor 43 turns off, the water supply solenoid valve 44 is turned on. Since the air pressure P2 applied on the stored water in the main tank 31 is higher than the air pressure P3 applied on the stored water in the sub tank 41 as described earlier, turning on the water supply solenoid valve 44 causes the inflow of the stored water in the main tank 31 into the sub tank 41 through the main aqueduct 7. As a result, the water level in the sub tank 41 is restored. When the water level in the sub tank 41 reaches the Lu so that the upper water level sensor 42 is turned on, the controller 48 turns off the water supply solenoid valve 44. As a result, no more water flows into the sub tank 41, and thus the space for compressed air to be fed is secured in the sub tank 41.

The central controller 9 controls the on-off switching of the water spouting solenoid valve 52 in each of the water spouting units 5 according to a predetermined control program in such a manner that spouting water is formed at predetermined order, number, and location, and simultaneously changes the target value P3 in order to change the height or size of the spouting water. The target value P3 is of course smaller than the target value P2 and larger than the atmospheric pressure. The target valve P3 is set high to form high or large spouting water.

An air pressure that approximately equals P3 is constantly applied on the stored water in the sub tank 41. When the water spouting solenoid valve 52, which is connected to the inside of the sub tank 41 through the terminal aqueduct 8, is turned on, the stored water with the pressure applied thereon runs through the terminal aqueduct 8 to reach the nozzle 51 and then vigorously spouts from the water spouting holes. As a result, a column of spouting water is formed from the end of the nozzle 51. The stored water in the sub tank 41 gradually decreases due to the spouting of water. However, the foregoing control of on-off switching of the pressurizing solenoid valve 46 maintains the air pressure in the sub tank 41 at P2, and thereby the flow rate of the water spouting from the nozzle 51 is held at approximately a constant level. When the central controller 9 changes the target value P3 in this state, the air pressure in the sub tank 41 changes accordingly. This changes the flow amount of the water spouting from the nozzle 51, causing changes in the height or size of the spouting water. Since changing the target value P3 almost immediately changes the air pressure in the sub tank 41, the height or size of the spouting water can be promptly and smoothly changed.

When the water level in the sub tank 41 falls below the Ll, the water supply solenoid valve 44 is turned on so that the stored water in the main tank 31 is supplied to the sub tank 41 as described earlier. While the stored water in the main tank 31 thus gradually decreases, the air pressure in the main tank 31 is maintained approximately at P1 by the previously described on-off control of the pressurizing solenoid valve 37. Accordingly, water is smoothly supplied from the main tank 31 through the main aqueduct 7 to the sub tank 41. It is thus possible to prevent the sub tank 41 from being emptied.

As described previously, the water spouting device according to the present embodiment controls the back pressure (air pressure in the upper space in the sub tank 41) for spouting water from each of the nozzles 51 and uses the water spouting solenoid 52 to control the spouting/stopping of water from the nozzle 51. As a result, the spouting of water can be promptly started/stopped without dripping, and the height or size of the spouting water can be promptly and smoothly changed.

Figure 2:
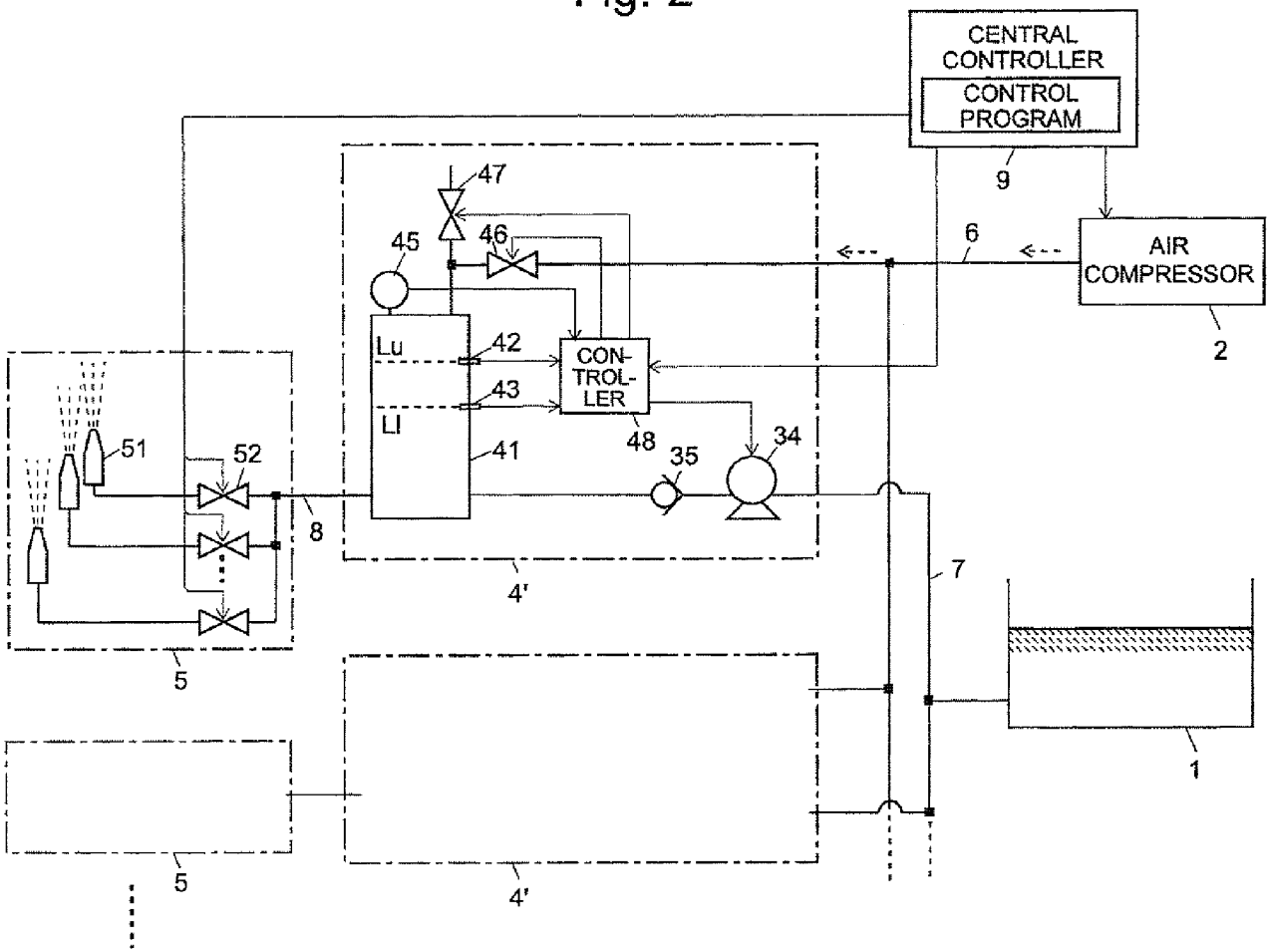
FIG. 2 is a schematic diagram showing a water spouting device according to another example of the present invention.

FIG. 2 is a diagram showing the main components of the water spouting device according to the second example. The principle of spouting water is basically the same as that in the first example, and the corresponding structural elements are marked with the same numerical symbols.

In the water spouting device according to the second example, the first tank unit 3 is not provided; the main aqueduct 7 connected to a water outlet in the lower portion of the water storage tank 1 is branched into multiple lines, with a second tank unit 4' being connected to the end of each line. In the second tank unit 4', the end of the main aqueduct 7 is connected to a water inlet of the pump 34, and a water outlet of the pump 34 is connected to the sub tank 41 through the check valve 35. The amount of the stored water in the sub tank 41 is controlled in the same manner as the control of the amount of water in the first tank unit 3 in the first example. The air pressure in the upper space in the sub tank 41 is controlled in the same manner as the control of the air pressure in the second tank unit 4 in the first example.

In this structure, each of the second tank units 4' includes the pump 34, and operation of the pump 34 supplies the water in the water storage tank 1 to the sub tank 41. This structure makes it possible to assuredly send a large amount of water as compared with the case of supplying water from the main tank 31 to the sub tank 41 by the pressure difference, even if for example the main aqueduct 7 is long and has a high passage resistance. For this reason, the structure is especially preferable for large-scale water spouting devices.

It should be noted that, the previously described examples are mere examples of the present invention, and other than those described thus far, any modification, adjustment, or addition appropriately made within the spirit of the present invention is also covered by the claims of the present patent application.

EXPLANATION OF NUMERALS

1 . . . Water Storage Tank
2 . . . Air Compressor
3 . . . First Tank Unit
31 . . . Main Tank
32 . . . Upper Water Level Sensor
33 . . . Lower Water Level Sensor
34 . . . Pump
35 . . . Check Valve
36 . . . Pressure Sensor
37 . . . Pressurizing Solenoid Valve
38 . . . Decompressing Solenoid Valve
39 . . . Controller
4, 4' . . . Second Tank Unit
41 . . . Sub Tank
42 . . . Upper Water Level Sensor
43 . . . Lower Water Level Sensor
44 . . . Water Supply Solenoid Valve
45 . . . Pressure Sensor
46 . . . Pressurizing Solenoid Valve
47 . . . Decompressing Solenoid Valve
48 . . . Controller
5 . . . Water Spouting Unit
51 . . . Nozzle
52 . . . Water Spouting Solenoid Valve
6 . . . Compressed Air Supply Tube
7 . . . Main Aqueduct
8 . . . Terminal Aqueduct
9 . . . Central Controller

The invention claimed is:

1. A water spouting device comprising:

a) a nozzle for spouting water;

b) a first closed water storage container for storing water at a water level within a predetermined range;

c) a first compressed air supplier for feeding compressed air in an upper space in the first water storage container;

d) a first aqueduct for connecting the first water storage container and the nozzle;

e) a first open/close valve provided at a point in the first aqueduct;

f) a controller for controlling spouting of water from the nozzle and stopping of the spouting water by opening or closing the first open/close valve, while controlling the first compressed air supplier on the feeding of compressed air in a manner as to maintain an air pressure in the upper space in the first water storage container at a predetermined level;

g) a water supplier for supplying water to the first water storage container, the water supplier including:

g1) a second closed water storage container for storing water at a water level within a predetermined range:

g2) a second compressed air supplier for feeding compressed air in an upper space in the second water storage container;

g3) a second aqueduct for connecting the second water storage container and the first water storage container: and g4) a second open/close valve provided at a point in the second aqueduct, wherein, the water-supply controller controls supply of water to the first water storage container and stopping of the water supply by opening or closing the second open/close valve, while controlling the second compressed air supplier on the feeding of compressed air in a manner as to maintain the air pressure in the upper space in the second water storage container at a second predetermined pressure that is higher than the predetermined pressure; and h) a water-supply controller for monitoring a water level in the first water storage container and controlling the water supplier to keep the water level within a predetermined range.

2. The water spouting device according to claim 1, wherein the controller changes the predetermined pressure depending on a predetermined height or size of the spouting water.

* * * * *